US006724277B2

(12) United States Patent
Holden et al.

(10) Patent No.: US 6,724,277 B2
(45) Date of Patent: Apr. 20, 2004

(54) RADIO FREQUENCY ANTENNA FEED STRUCTURES HAVING A COAXIAL WAVEGUIDE AND ASYMMETRIC SEPTUM

(75) Inventors: Richard H. Holden, Maynard, MA (US); Fernando Beltran, Mashpee, MA (US); John J. Hanlin, Worcester, MA (US)

(73) Assignee: Raytheon Company, Waltham, MA (US)

( * ) Notice: Subject to any disclaimer, the term of this patent is extended or adjusted under 35 U.S.C. 154(b) by 67 days.

(21) Appl. No.: 09/771,435

(22) Filed: Jan. 24, 2001

(65) Prior Publication Data

US 2002/0097111 A1 Jul. 25, 2002

(51) Int. Cl.[7] ..... H01P 5/12; H01P 1/161
(52) U.S. Cl. ..... 333/125; 333/137; 333/21 A
(58) Field of Search ..... 333/21 A, 137, 333/135, 126, 125

(56) References Cited

U.S. PATENT DOCUMENTS

| | | | | |
|---|---|---|---|---|
| 5,245,353 A | | 9/1993 | Gould | |
| 5,793,334 A | * | 8/1998 | Anderson et al. | 333/126 X |
| 6,005,528 A | * | 12/1999 | Preiss et al. | 333/126 X |
| 6,225,875 B1 | * | 5/2001 | Kich | 333/21 A X |
| 2001/0011933 A1 | * | 8/2001 | Enokuma | 333/315 |

FOREIGN PATENT DOCUMENTS

EP 2000332503 11/2000

OTHER PUBLICATIONS

Henderson, R. J. et al., "Compact Circularly–Polarised Coaxial Feed", Apr. 4–7, 1995, pp. 327–330, vol. 1, XP002200085, London, UK, Ninth International Conference on Antennas and Propagation (Conf. Publ. No. 407); IEEE.

Gruner, R. W., "Compact dual–polarized diplexers for 4/6–gHz earth station applications", International Symposium on Antennas and Propagation, Piscataway, IEEE, US, vol. Part 1, Jun. 20, 1977, pp. 341–344, XP002175354.

* cited by examiner

*Primary Examiner*—Benny Lee
(74) *Attorney, Agent, or Firm*—Daly, Crowley & Mofford, LLP

(57) ABSTRACT

A waveguide feed structure having a coaxial transmission line. A conductive, planar septum is disposed in, and along a diameter of, the transmission line. A feed port is electrically coupled to the transmission line. The septum has a rear portion disposed proximate the feed port, such rear portion of the septum extending between the inner conductor and the outer conductor. The feed port and the rear portion of the septum are arranged to establish an electric field in the transmission line between the inner conductor and the outer conductor with a component substantially $TE_{11}$ mode along a direction perpendicular to the planar septum. A forward portion of the septum is asymmetrically disposed with respect to said diameter in order to provide a gap between the inner conductor and the outer conductor, such gap establishing an electric field component within the transmission line having a $TE_{11}$ component along said diameter of the transmission line parallel to the plane of the septum. The septum has a pair of distal ends. One of the ends is separated from a proximate portion of the outer conductor has a distance different from the separation between the other one of the pair of ends and a proximate portion of the outer conductor. In one embodiment, the first-mentioned distance increases along the transmission line from the rear portion of the septum to the forward portion of the septum. The distance is increased in steps to provide a 90 degree phase shift to energy propagating along the transmission line between a distal end of the septum and the outer conductor.

6 Claims, 9 Drawing Sheets

RADIO FREQUENCY ANTENNA FEED STRUCTURES HAVING A COAXIAL WAVEGUIDE AND ASYMMETRIC SEPTUM

RIGHTS OF THE GOVERNMENT

This invention was made with Government support under contract No. N00039-97-C-0030 awarded by the Department of the Navy. The Government has certain rights in this invention.

TECHNICAL FIELD

This invention relates generally to radio frequency antenna feed structures and, more particularly, to feed structures having septum polarizers.

BACKGROUND

As is known in the art, in many radio frequency communication systems, a pair of independent signals are transmitted and received as a composite signal of circularly polarized energy. More particularly, each one of a pair of signals is transmitted and received with a corresponding one of two senses of polarization of the composite circularly polarized signal; i.e., one of the pair of signals as a right-hand circularly polarized energy component and the other one of the pair of signals as a left-hand circularly polarized energy component. Such systems therefore require the use of an antenna feed having a pair of electrically isolated feed ports. During transmission, each of the feed ports is fed by a corresponding one of a pair of radio frequency signals. It should be noted that the feed ports may be fed simultaneously or at different periods of time. The feed then combines the two signals into composite circularly polarized energy; the right-hand sense polarized component of such energy carrying one of the pair of signals and the left-hand sense polarized component of such energy carrying the other one of the pair of signals. During reception the feed operates in a reciprocal manner. That is, the composite circularly polarized energy received by the feed is separated by the feed into a right-hand circularly polarized energy component which carries one of a pair of signals and a left-hand circularly polarized component which carries the other one of the pair of signals. The feed then couples the right-hand circularly polarized component to one of the pair of electrically isolated feed ports and couples the left-hand circularly polarized component to the other one of the pair of feed ports.

As is also known in the art, one desirable type of feed is a coaxial feed 10. Here, the feed includes an outer conductor and an inner conductor. The circularly polarized energy travels along the length of the feed between the inner and outer conductors. One such feed is shown in FIGS. 1, 2 and 3. Such feed 10 includes two separate devices: (A) a rear orthogonal mode transducer (OMT) 12; and (B) a forward waveguide quarter-wave polarizer 14 having a pair of dielectric vanes 16. The OMT 12 includes a pair of feed ports 18, 20 electrically isolated by conductive plates 22 which extend between the inner conductor 24 and the outer conductor 26 along a diameter of the coaxial feed 10, as shown more clearly in FIG. 2. The waveguide quarter-wave polarizer includes the dielectric vanes 16, such vanes extending along a diameter of the feed 10, such diameter being at a 45 degree angle with respect to the conductive plates 22 (i.e., a septum) to thereby convert between circularly polarized energy and linearly polarized. Thus, for example, on receive, right-hand circular energy is converted into horizontal (linear) polarization and the left-hand circularly polarized energy is converted into vertically polarized energy. The horizontal polarized energy passes to one of the pair of electrically isolated ports and the vertically polarized energy passes to the other one of the electrically isolated ports. Reciprocally, linearly polarized energy introduced into one of the electrically isolated feed ports is converted into circularly polarized energy with one sense of polarization, for example, right-hand circularly polarized energy. While such a feed operates satisfactorily in many applications, it is a relatively large structure and requires lossy dielectric materials. Further, because the dominant mode in a coaxial waveguide is the TEM mode, and in the application described above the desired modes are the $TE_{11}$ vertical and $TE_{11}$ horizontal modes, any successful coaxial septum polarizer design must provide these desired modes while carefully avoiding excessive excitation of the TEM mode.

SUMMARY OF THE INVENTION

In accordance with one feature of the invention, a waveguide feed structure is provided having a coaxial transmission line. A conductive, planar septum is disposed in, and along a diameter of, the transmission line. A feed port is electrically coupled to the transmission line. The septum has a rear portion disposed proximate the feed port. The feed port and the rear portion of the septum are arranged to establish an electric field in the transmission line between the inner conductor and the outer conductor with a component substantially perpendicular to the planar conductive septum. A forward portion of the septum is asymmetrically disposed along the diameter to establish an electric field component within the transmission line along said diameter of the transmission line.

In one embodiment, a pair of feed ports is provided. The rear portion of the septum is disposed proximate the feed ports to electrically isolate one of the feed ports from the other one of the feed ports.

In one embodiment, a waveguide feed structure is provided having a coaxial transmission line. A conductive, planar septum is disposed in, and along a diameter of, the transmission line. A feed port is electrically coupled to the transmission line. The septum has a rear portion disposed proximate the feed port, such rear portion of the septum extending between the inner conductor and the outer conductor. The feed port and the rear portion of the septum are arranged to establish an electric field in the transmission line between the inner conductor and the outer conductor with a component substantially $TE_{11}$ mode along a direction perpendicular to the planar septum. A forward portion of the septum is asymmetrically disposed along the diameter to provide a gap between the inner conductor and the outer conductor, such gap establishing an electric field component within the transmission line having a $TE_{11}$ component along said diameter of the transmission line. In one embodiment, the septum has a pair of distal ends. One of the ends is separated from a proximate portion of the outer conductor with a distance of such separation being different from a distance between the other one of the pair of ends and a proximate portion of the outer conductor. In one embodiment, the first-mentioned distance increases along the transmission line from the rear portion of the septum to the forward portion of the septum.

In one embodiment, the distance is increased in steps to provide a phase shift to energy propagating along the transmission line between a distal end of the septum and the outer conductor. In one embodiment the phase shift is approximately 90 degrees over the frequency band of operation.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION OF THE INVENTION

Figure 1:
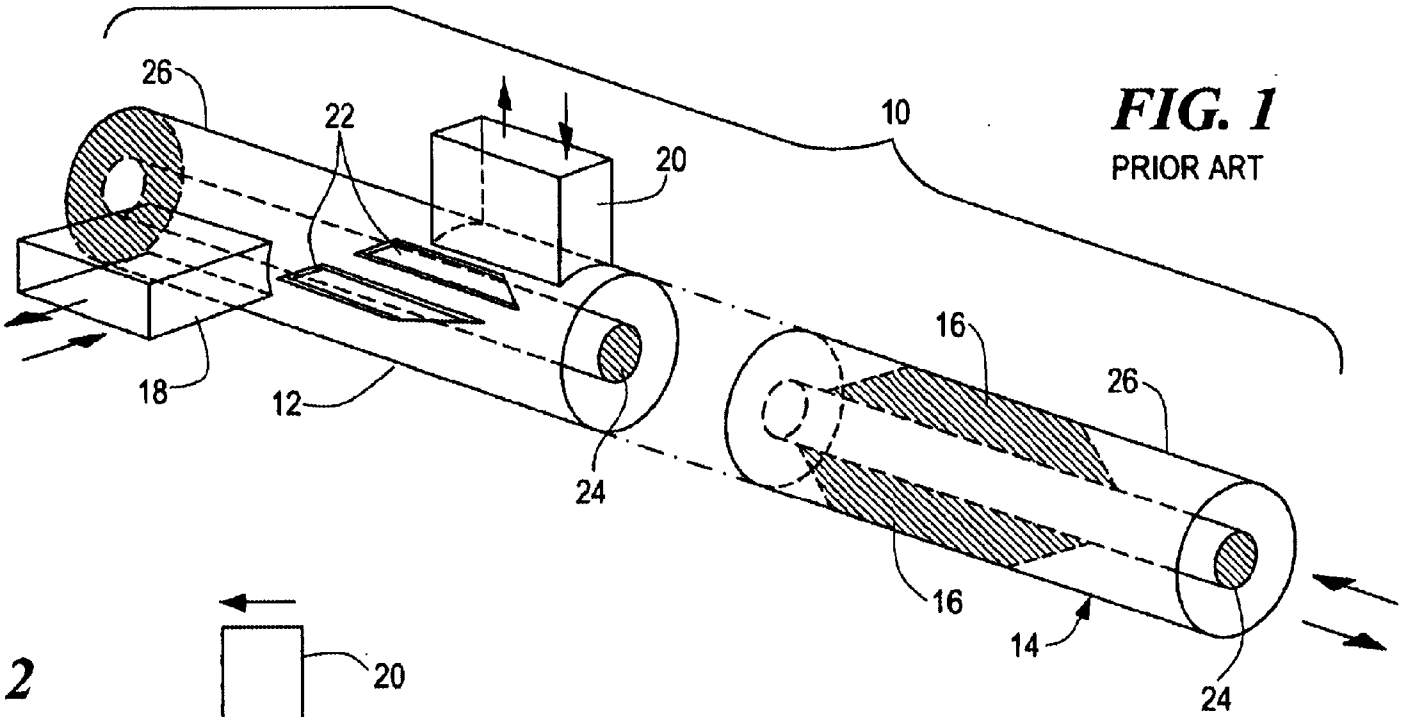
FIG. 1 PRIOR ART
FIG. 1 is an isometric, exploded sketch of a coaxial feed having a rear orthogonal mode transducer (OMT) and a forward waveguide quarter-wave polarizer according to the PRIOR ART.
Figure 3:
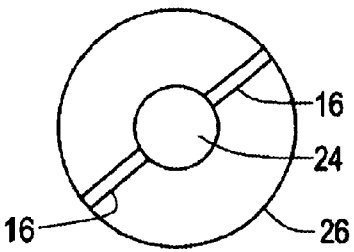
FIG. 3 PRIOR ART
FIG. 3 is a cross-sectional sketch of the quarter-wave polarizer portion of the feed of FIG. 1 according to the PRIOR ART.
Figure 2:
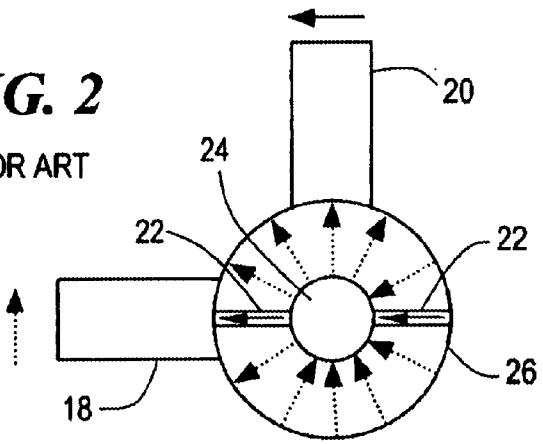
FIG. 2 PRIOR ART
FIG. 2 is a cross-sectional sketch of the OMT portion of the feed of FIG. 1 according to the PRIOR ART.
Figure 4:
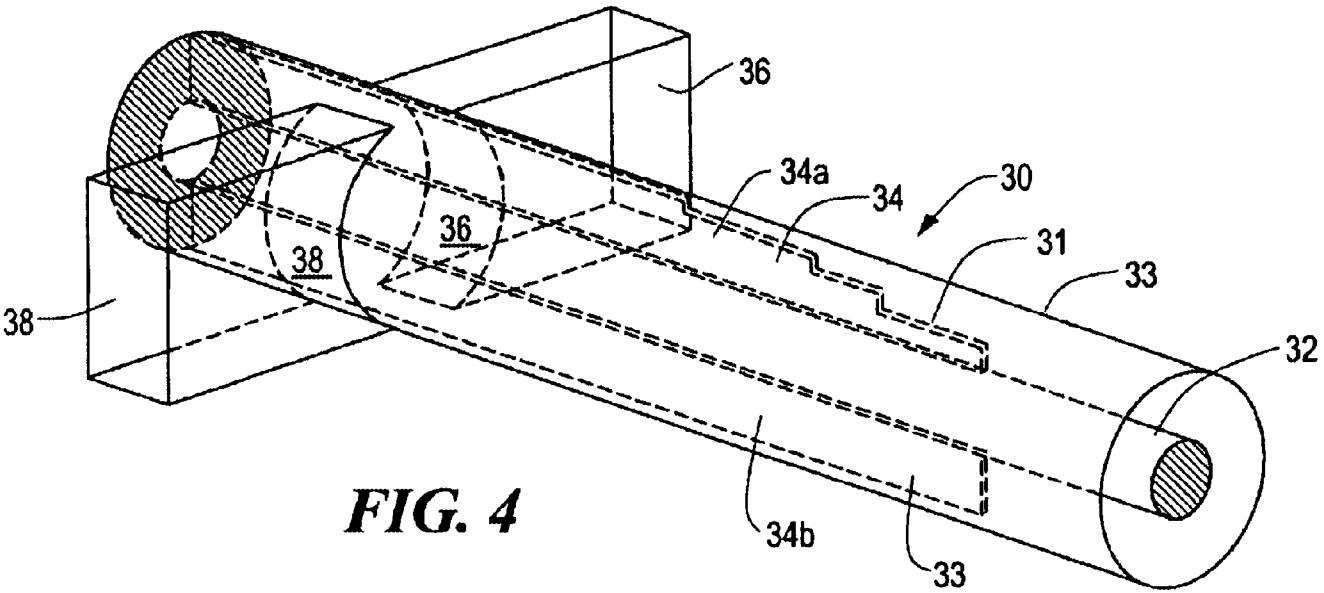
FIG. 4 is an isometric sketch of a coaxial feed according to the invention.

Referring now to FIG. 4, a radio frequency antenna feed structure 30 is shown. The feed structure 30 is a waveguide feed structure having a coaxial transmission line 31. More particularly, the coaxial transmission line includes an inner conductor 32 and an outer conductor 33. The outer conductor 33 and inner conductor 32 are coaxial and each has a circular cross-section, as shown more clearly in FIG. 5. Here the coaxial transmission line 31 has inner and outer conductors with circular cross-sections. It should be understood that the coaxial transmission lines 31 may have elliptical or rectangular cross sections. That is the coaxial transmission line 31 has a pair of elongated inner and outer conductors which have a common longitudinal axis.

Figure 5:
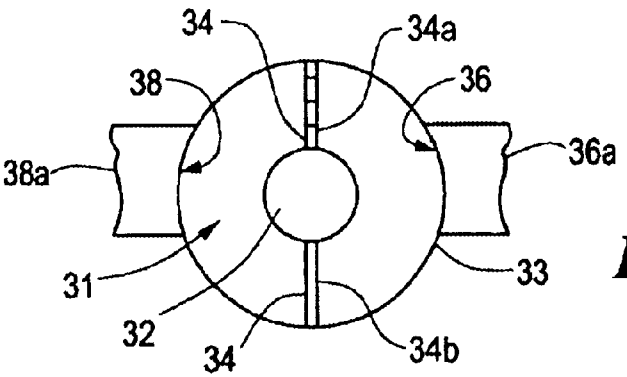
FIG. 5 is a front-elevation view of the feed of FIG. 4.

The waveguide feed structure 30 also includes a conductive, planar septum 34 disposed in, and along a diameter of, the transmission line 31, as shown more clearly in FIG. 5. More particularly the septum 34 has two sections 34*a* and 34*b:* one section, here section 34*a,* is disposed along a radius of the transmission line and the other section, here section 34*b,* is disposed along another radius of the transmission line. The two radii are 180 degrees with respect to each other, i.e.; both radii are disposed along a common diameter of the transmission line.

Figure 7:
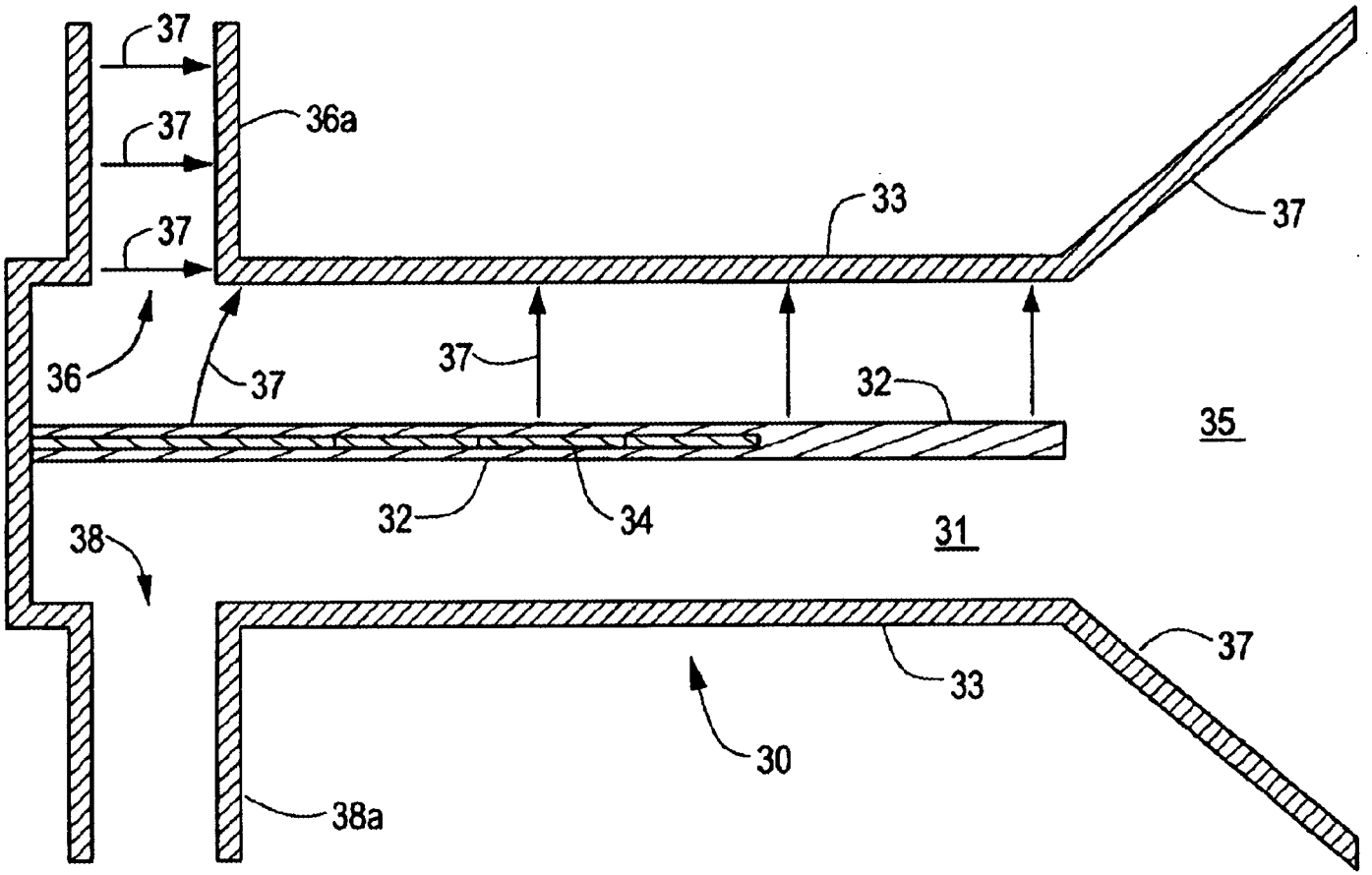

The feed structure 30 also includes a pair of feed ports 36, 38 electrically coupled to the transmission line 31. Here, each one of the feed ports 36, 38 terminates at an end of a corresponding one of a pair of rectangular waveguides 36*a,* 38*a,* respectively, as indicated more clearly in FIG. 7.

Figure 6:
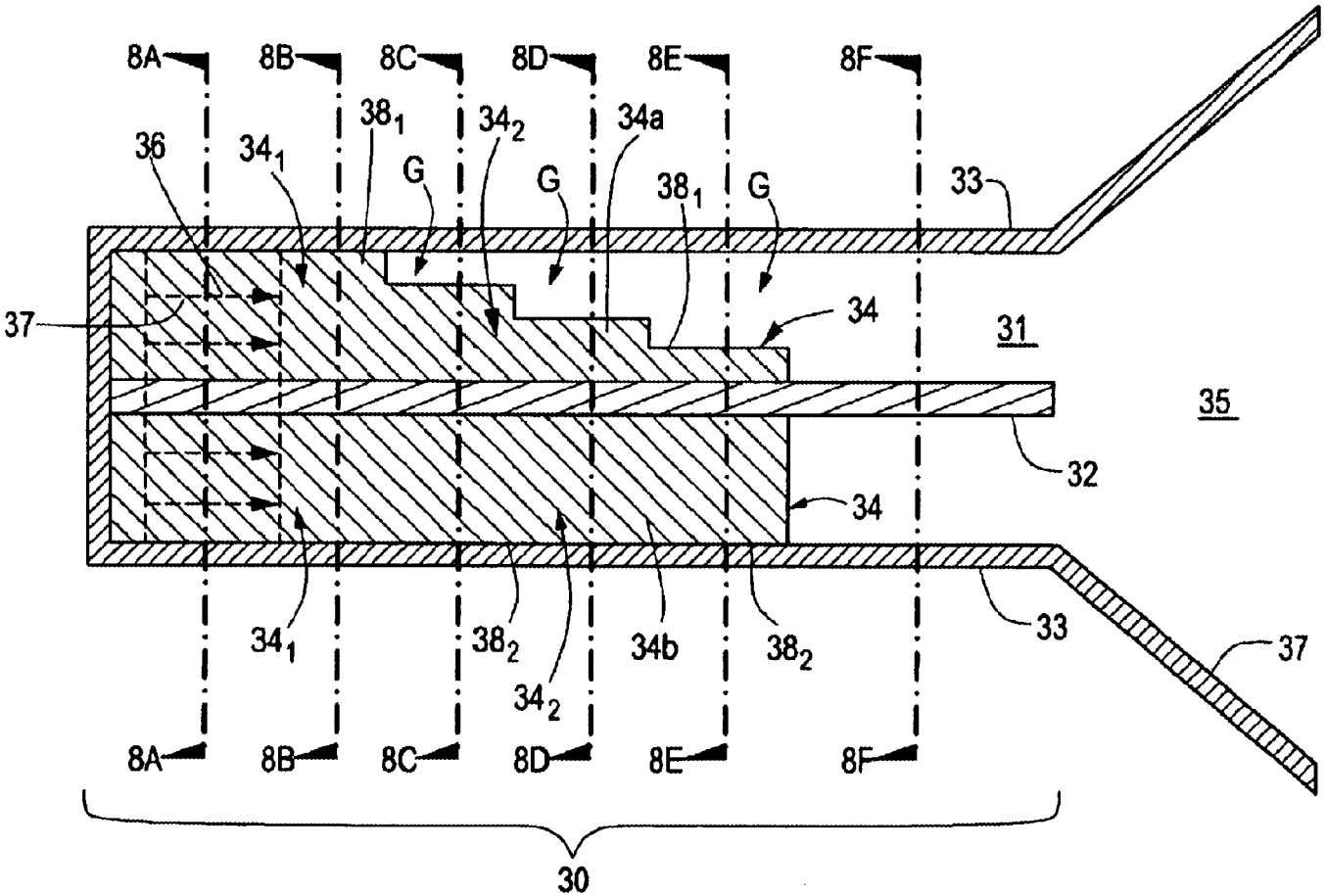
FIGS. 6 and 7 are cross-sectional views of the feed of FIG. 4, here such feed being shown coupled to a horn portion of an antenna, one of the cross-sections being taken at a 90 degree angle with respect to the other one of the cross-sections.

Referring also to FIG. 6, the septum 34 has a rear portion $\mathbf{34}_1$ disposed proximate the feed ports 36, 38. The rear portion $\mathbf{34}_1$ of the septum 34 extends between the inner conductor 32 and the outer conductor 33 and thus electrically isolates the pair of feed ports from each other, as shown more clearly in FIGS. 6 and 7. More particularly, both sections 34*a* and 34*b* of the rear portion $\mathbf{34}_1$ of the septum 34 extend between the inner conductor 32 and the outer conductor 34, as shown more clearly in FIG. 6. Further, each one of the feed ports 36, 38 and the rear portion $\mathbf{34}_1$ of the septum 34 are arranged to establish an electric field (indicated by arrows 37 in FIG. 7) in the transmission line 31 between the inner conductor 32 and the outer conductor 34 with a substantially $TE_{11}$ mode component along a direction perpendicular to the planar septum for an exemplary one of the pair of feed ports 36, 38, here feed port 36.

Figure 8A:
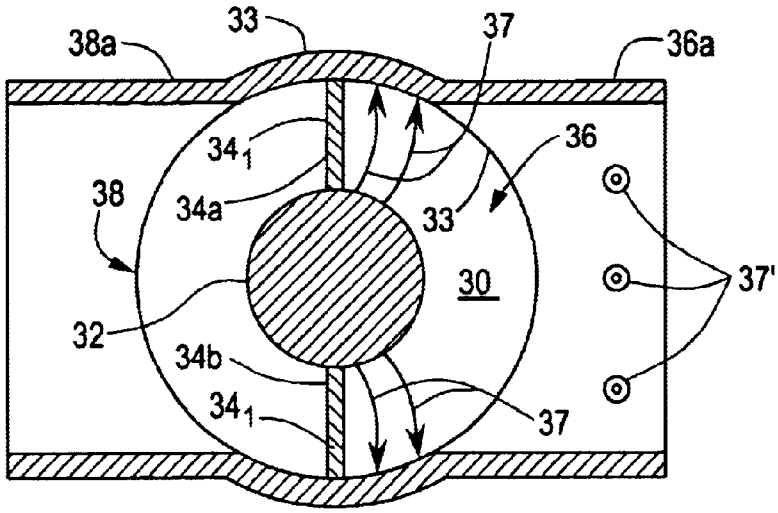
FIGS. 8A, 8B, 8C, 8D, 8E and 8F are cross-sectional views taken perpendicular to the elongated axis of the feed of FIG. 4, such cross-sections being taken along lines 8A—8A through 8F—8F, respectively, in FIG. 6, each one of the cross-sectional views showing the electric fields within the feed.
Figure 8B:
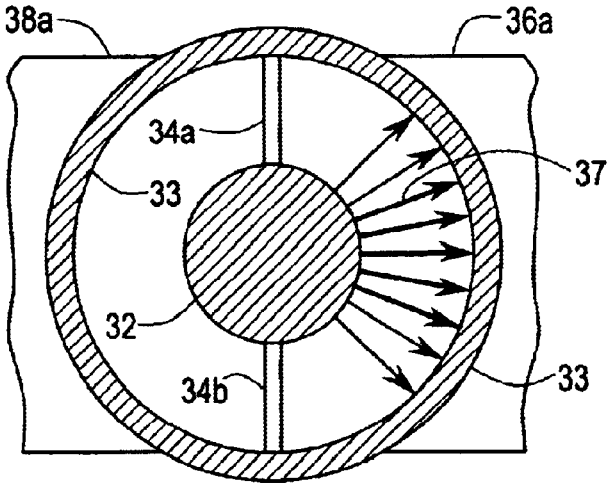

Referring to FIGS. 8A and 8B, a cross-section of the rear portion $\mathbf{34}_1$ of the septum 34 is shown. As noted from FIGS. 6 and 7, the rear portion $\mathbf{34}_1$ of the septum is proximate the feed ports 36, 38 and, as noted from FIGS. 8A and 8B, the rear portion $\mathbf{34}_1$ of the septum extends between the center conductor 32 and the outer conductor 33 (FIG. 8A). More particularly, both sections 34*a* and 34*b* (FIG. 8B) extend along diametrically opposed radii and are of the same length. Thus, the septum 34 in the rear portion $\mathbf{34}_1$ thereof is symmetrically disposed with respect to a diameter of the transmission line which is perpendicular to the plane of the septum 34. The forward portion $\mathbf{34}_2$ (FIG. 6) of the septum 34 is asymmetrically disposed along the diameter of the transmission line 30, as shown in FIGS. 8B through 8E.

More particularly, as shown in FIG. 6, the septum 34 has a pair of distal ends $\mathbf{38}_1$, $\mathbf{38}_2$. The distance between one of the pair of ends, here end $\mathbf{38}_1$ and a proximate portion of the outer conductor 33 is different from the distance between the other one of the pair of ends, here $\mathbf{38}_2$ and a proximate portion of the outer conductor 33. Here, one of the distal ends, here end $\mathbf{38}_2$, contacts the proximate end of the outer conductor 33 along the entire length of the septum 34. The other one of the distal ends, here $\mathbf{38}_1$, is separated from the proximate portion of the outer conductor by a small gap, G, along the forward portion $\mathbf{34}_2$ of the septum 34. It should be noted that the gap G increases as the septum 34 progresses forward toward the radiating end 35, i.e. the horn 37. Here, the gap G is increased in steps to provide a phase shift to energy propagating along the transmission line 30 between such distal end $\mathbf{34}_1$ of the septum 34 the outer conductor 33. Here, the forward portion $\mathbf{34}_2$ of section 34*a* of septum 34 has 3 steps and is configured to provide a phase shift of 90 degrees to the electric energy passing along the transmission line along the gap G.

Referring now to FIGS. 8A through 8F, and considering the case where energy is fed into one of the feed ports, here feed port 36; it is first noted that the electric field, indicated by arrows 37, of the dominant mode in the feed port 36, is produced across the narrow walls of the rectangular guide 36*a*. Thus, in FIG. 8A, the direction of the electric field is into the plane of the drawing as represented by the dot-circle symbol 37'. As the energy in the feed port 36 enters the coaxial transmission line 30, the electric field bends 90 degrees so that it extends between the inner conductor 32 and the outer conductor 33. Slightly forward of the feed port 36, as shown in FIG. 8B, it is noted that the electric field 37 extends in a substantially horizontal direction, i.e., in a strong quasi-$TE_{11}$ horizontal mode. It is noted that the rear portion $\mathbf{34}_1$ of the septum 34 (the portion proximate the feed ports) has the effect of electrically isolating the feed ports 36,38 one from the other. That is, since the rear portion $\mathbf{34}_1$ provides a conductive wall, which extends from the inner conductor 32 to the outer conductor 33, such wall in effect bifurcates the coaxial transmission line 30 into two electrically isolated regions.

Figure 8C:
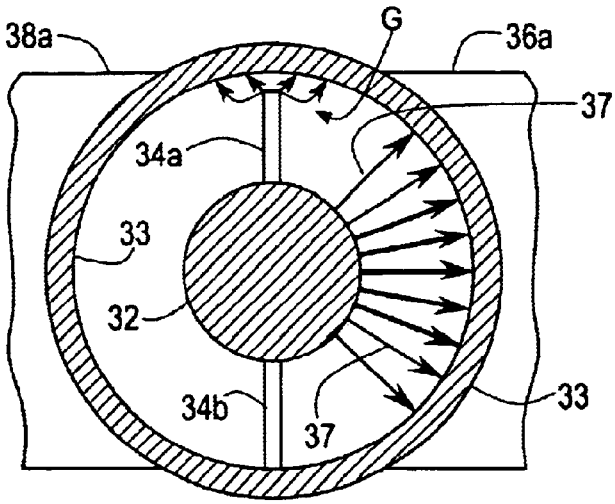
Figure 8D:
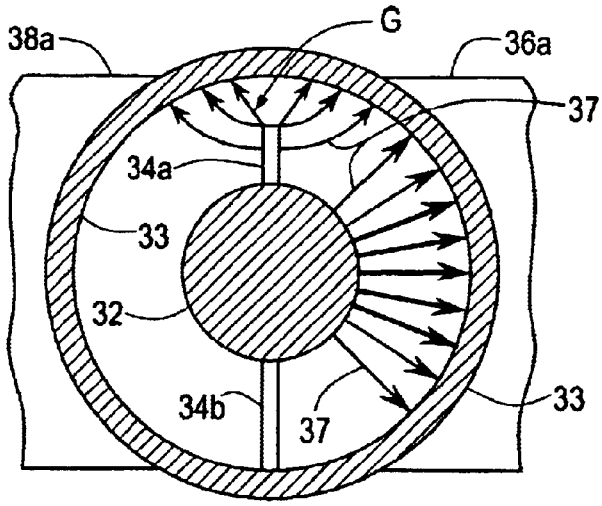
Figure 8E:
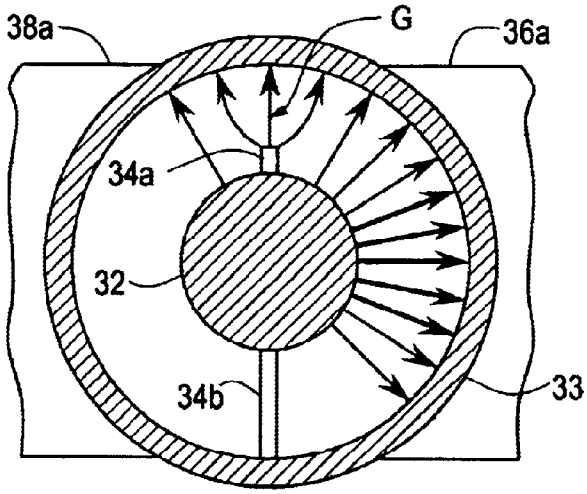

Referring now to FIG. 8C, it is noted that the gap, G, increases slightly while the edge of septum portion 34*b* remains in contact with the outer conductor 33 and the inner conductor 32. Thus, an electric field 37 develops in the gap, G, between the edge of septum portion 34*a* and the outer conductor 33. The electric field 37 developed in gap G is substantially vertical in orientation, as shown in FIGS. 8C through 8E and may be considered as a quasi-$TE_{11}$ mode. It is noted that if there were a gap between the edge of septum portion 34*b* and the outer conductor 33 of the same width as gap G, an electric field would also have been developed in such gap of the same magnitude as that developed in gap G. In such case, however, because one electric field would be vertical in an upward direction while the other electric field would be vertical in a downward direction, the two fields would couple strongly into the undesired TEM mode and would not couple into the desired $TE_{11}$ vertical mode. Thus, the asymmetric nature of the septum 34 (i.e., the forward portion $\mathbf{34}_2$ which is asymmetrical with respect to a diameter perpendicular to the plane of the septum 34, as shown in FIGS. 8B through 8E) thereby results in the production of a net quasi-$TE_{11}$ vertical mode electric field.

Figure 8F:
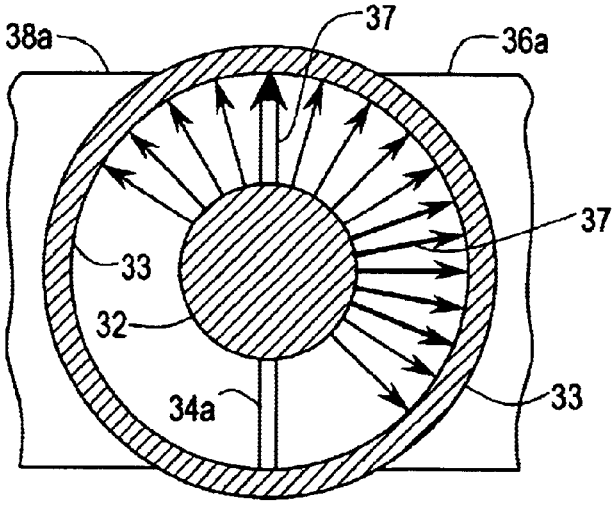

Referring to FIGS. 8D through 8F, it is seen that as the energy propagates forward, the electric field across the more widening gap G (FIGS. 8D, 8E) increases in strength to thereby produce at the horn an electric field having both a strong $TE_{11}$ vertical mode and a strong $TE_{11}$ horizontal mode. It is noted that the steps along the septum provide phase shift to the quasi-vertical $TE_{11}$ mode energy; here such vertical $TE_{11}$ mode energy having a 90 degrees phase shift imparted to it as it passes along the gap. Thus, the resultant electric field has both a vertical and horizontal $TE_{11}$ mode component with one having a 90 degree phase shift with respect to the other so that the resulting transmitted energy is circularly polarized.

Thus, at the first step in portion 34*a,* (FIG. 8C), at the right-hand side of the septum wall, nearly half the energy from the horizontal $TE_{11}$ mode continues to propagate unaffected. The rest of the energy couples into the quasi-TEM mode or quasi-$TE_{11}$ vertical mode. Pure TEM or $TE_{11}$ vertical modes cannot exist because of the presence of the septum wall.

In the second step in portion 34*a,* (FIG. 8D), the horizontal $TE_{11}$ mode continues to propagate unaffected. The remaining energy couples more strongly into the quasi-$TE_{11}$ vertical mode than the quasi-TEM mode. At each step, the quasi-$TE_{11}$ vertical mode is advanced in phase with respect to the horizontal mode.

In the third step of portion 34*a* (FIG. 8E), energy in the horizontal $TE_{11}$ mode continues to propagate unaffected. The remaining energy again couples more strongly into the quasi-$TE_{11}$ vertical mode than the quasi-TEM mode. The electric field approaches the lower septum of the waveguide in the quasi-$TE_{11}$ vertical mode in this section thereof.

At the final step, both the upper and lower septum walls vanish and nearly half the power continues in the horizontal $TE_{11}$ mode. Nearly the same amount of power propagates in the vertical $TE_{11}$ mode and a very small portion propagates in the TEM mode. The horizontal and vertical $TE_{11}$ modes are now 90 degrees out of phase with one another as required for circular polarization.

If left hand circularly polarized energy is desired, then microwave energy is fed into feed port 38 and no energy is feed into feed port 36. If right-hand circularly polarized energy is desired, microwave energy is fed into feed port 36 and no energy is fed into feed port 38. If both right- and left-hand circularly polarized energy is desired, energy is fed into both feed ports 36 and 38.

On receive, the feed 30 (FIG. 4) receives right-hand or left-hand circularly polarized energy and directs them to port 36 and 38, respectively.

Figure 9:
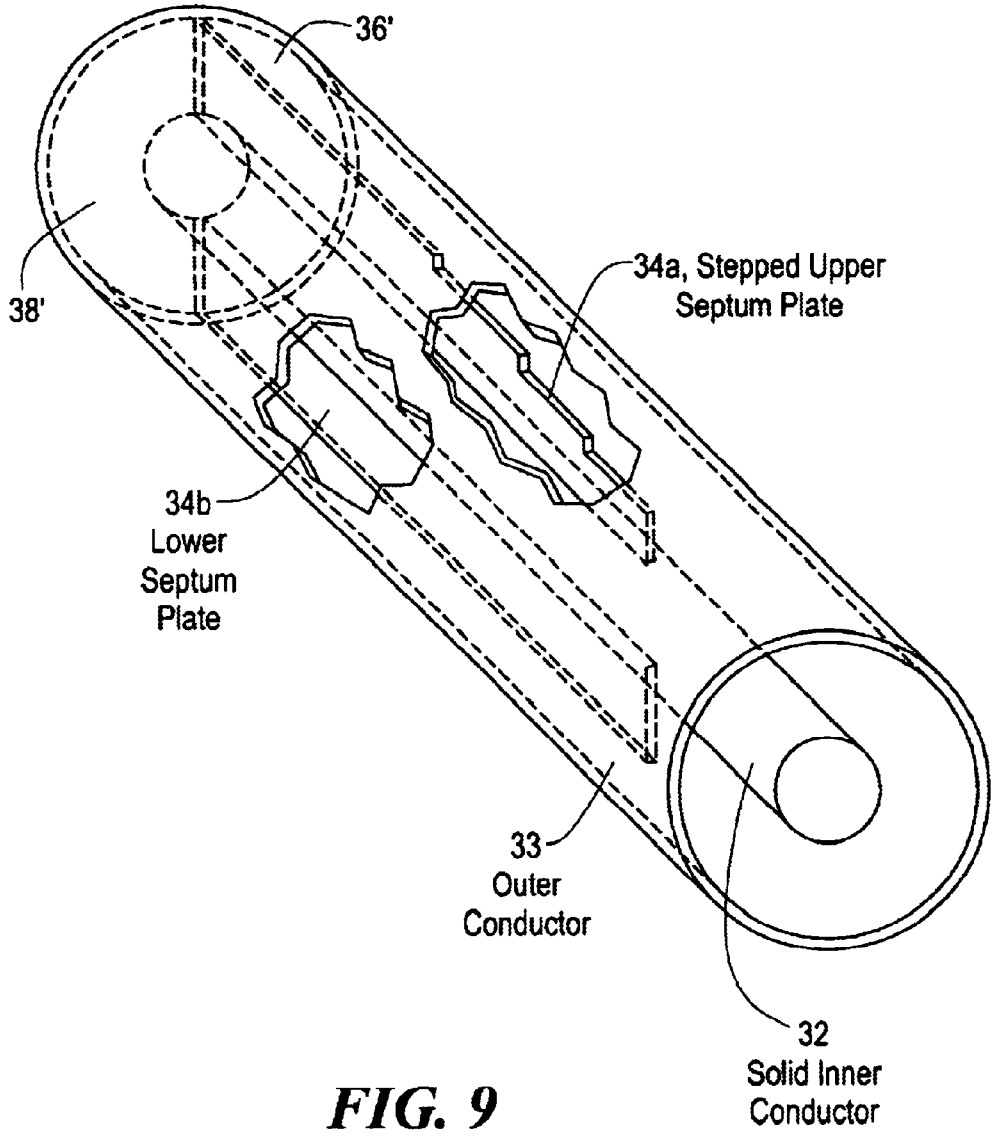
FIG. 9 is an isometric, partially broken away sketch of a feed structure according to an alternative embodiment of the invention.
Figure 10:
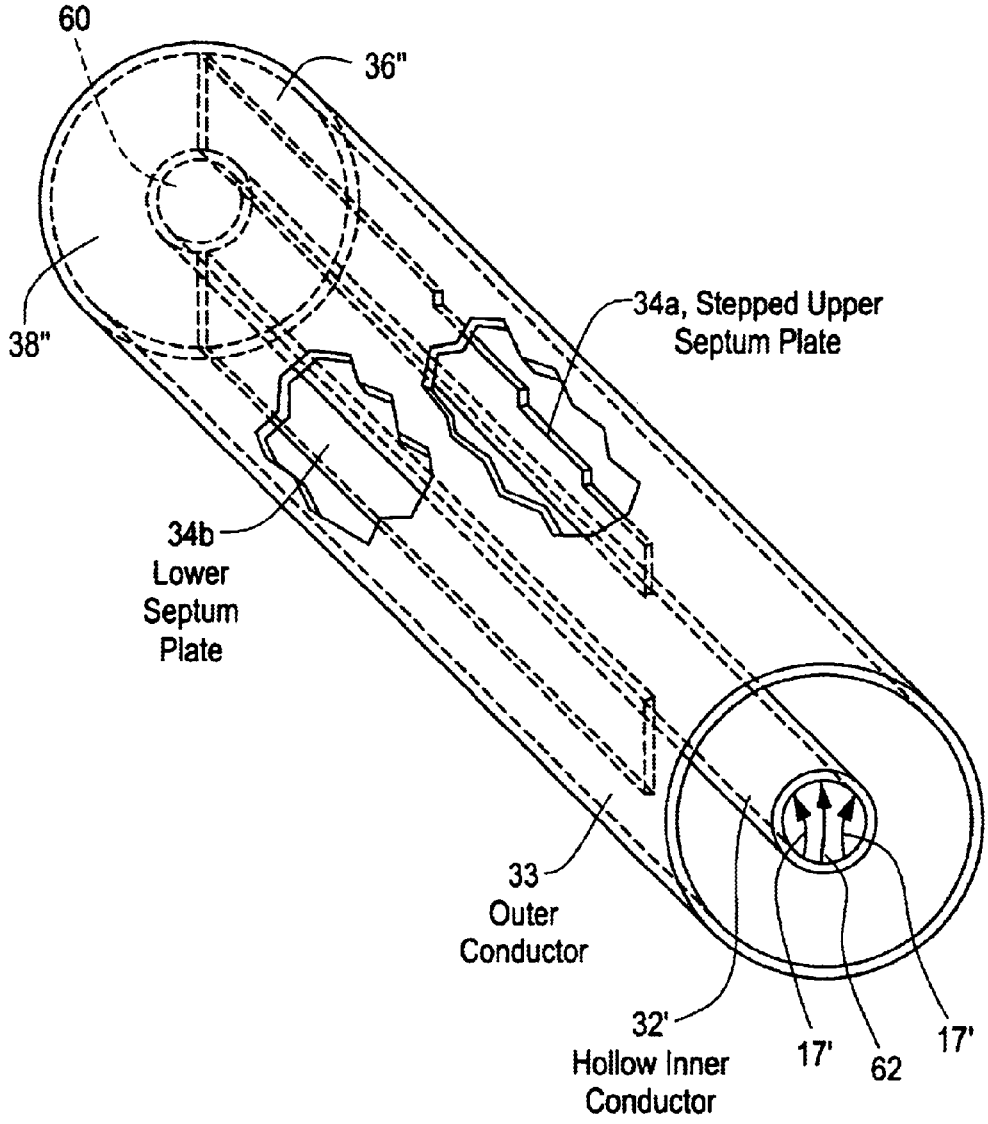
FIG. 10 is an isometric, partially broken away sketch of a feed structure according to another embodiment of the invention.
Figure 11:
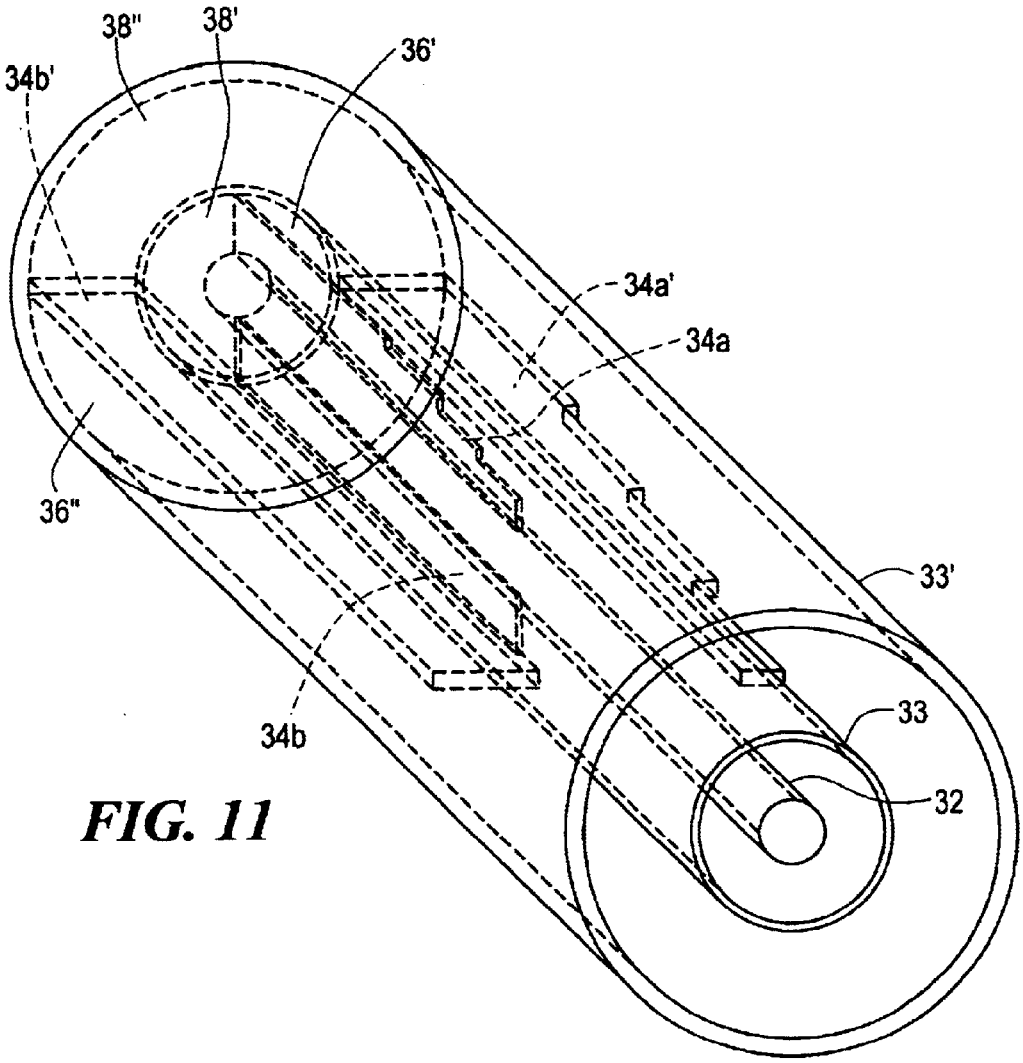
FIG. 11 is an isometric sketch of a feed structure according to another embodiment of the invention.
Figure 12:
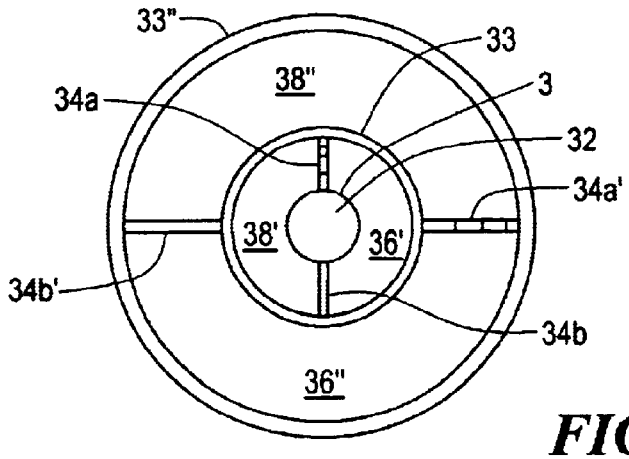
FIG. 12 is a front elevation view of the feed of FIG. 11.

A number of embodiments of the invention have been described. Nevertheless, it will be understood that various modifications may be made without departing from the spirit and scope of the invention. For example, the feed structure 30 of FIG. 4 may have feed 36', 38' at the rear of the circular transmission line as shown in FIG. 9. The rear portion of the septum again electrically isolates the feed ports 36' 38' from each other. Also, the feed structure may have a hollow center conductor, such as shown in FIG. 10 for center conductor 32'. Thus, the feed structure shown in FIG. 10 has a port 60 at the rear end thereof and a port 62 at the front end thereof. The electric field in this circular waveguide provided by the hollow center conductor 32' is shown and designated by the arrows 17'. The hollow center conductor 32' may operate at a different frequency band from that provided by the coaxial waveguide. In another example, another instance of the invention, scaled up in size, or a plurality of such scaled instances of the invention, may be wrapped around the first instance of the invention in a coaxial manner to provide additional ports for multiple frequency band operation as shown in FIGS. 11 and 12. Thus, in the embodiment shown in FIGS. 11 and 12 the feed structure shown and described above in connection with FIG. 9 includes an additional outer conductor 33'. A septum having sections 34*a*' and 34*b*' is provided between conductor pairs 33 and 33' to form a first coaxial transmission line. A second septum having sections 34*a*, 34*b* is provided between conductor pairs 32 and 33 as described above in connection with FIG. 9 to provide a second coaxial transmission line. Further, the plane of the septum of each additional instance of the invention may be oriented at an arbitrary angle to the plane of the septum of the first and subsequent instances. Thus, as shown in FIGS. 11 and 12, the feed structure, includes a plurality of electrical conductors 32, 33, 33' having a common longitudinal axis. Each pair of adjacent ones of the conductors forming a coaxial transmission line. Such transmission line has a conductive, planar septum disposed in, and along a diameter of, the transmission line. The coaxial transmission line has a feed port (i.e., ports 36', 38' or 36", 38") in FIG. 11 electrically coupled to the transmission line. The septum has a rear portion disposed proximate the feed port. The feed port and the rear portion of the septum are arranged to establish an electric field in the transmission line between the inner conductor and the outer conductor with a component substantially perpendicular to the planar conductive septum. A forward portion of the septum is asymmetrically disposed along said diameter to establish an electric field component along said diameter of the transmission line. While here the septum between conductors 32, 33 are 90 degrees with respect to the septum between conductors 33 and 33', other angular orientations may be used. Further, additional coaxial transmission lines, i.e., more than the two shown in FIGS. 11 and 12 may be provided. It should also be noted that the coaxial waveguide need not be composed of circular cross-sections. Indeed, as noted above, the inner and outer conductor cross-sections may be substantially elliptical or rectangular. Moreover, the two sections of the septum, 34*a* and 34*b*, need not have precisely the shape or lengths depicted in the FIGS contained herein. Sections 34*a* and 34*b*, and/or 34*a*', 34*b*', as the case may be, may have different lengths from one another, and section 34*b* may also exhibit a gap between the septum and the outer conductor 33. Such gaps need not comprise discrete steps but may also comprise continuous curves or straight lines. The essential point is that, whatever the shapes exhibited by sections 34*a* and 34*b*, a substantial degree of asymmetry must exist in the overall septum shape with respect to a diameter taken in the plane perpendicular to the plane of the septum.

Accordingly, other embodiments are within the spirit and scope of the following claims.

What is claimed is:

1. A feed structure, comprising:

a plurality of electrical conductors having a common longitudinal axis, a first one of the conductors and a second one of the conductors providing a first coaxial transmission line and the second one of the conductors and a third one of the conductors providing a second coaxial transmission line;

a first conductive, planar septum disposed in, and along a diameter of, the first transmission line;

a second conductive, planar septum disposed in, and along a diameter of, the second transmission line;

wherein the first septum has a rear portion disposed proximate a first feed port;

wherein the second septum has a rear portion disposed proximate a second feed port;

wherein the first feed port and the rear portion of the first septum are arranged to establish an electric field in the first transmission line between the first conductor and the second conductor with a component substantially perpendicular to the first planar conductive septum;

wherein the second feed port and the rear portion of the second septum are arranged to establish an electric field in the second transmission line between the second conductor and the third conductor with a component substantially perpendicular to the second planar conductive septum;

wherein a forward portion of the first septum is asymmetrically disposed along said diameter to establish an electric field component along said diameter of the first transmission line, said first septum having a pair of distal ends, a first distance between one of the pair of ends and a proximate portion of the second conductor being different from a second distance between the other one of the pair of ends and a proximate portion of the second conductor; and wherein a forward portion of the second septum is asymmetrically disposed along said diameter to establish an electric field component along said diameter of the second transmission line, said second septum having a pair of distal ends, a third distance between one of the pair of ends of the second septum and a proximate portion of the third conductor being different from a fourth distance between the other one of the pair of ends of the second septum and a proximate portion of the third conductor.

2. A waveguide feed structure, comprising:

a coaxial transmission line having an inner conductor and an outer conductor;

a conductive, planar septum disposed in, and along a diameter of, the transmission line;

a feed port electrically coupled to the transmission line;

wherein the septum has a rear portion disposed proximate the feed port, said rear portion of the septum extending between the inner conductor and the outer conductor;

wherein the feed port and the rear portion of the septum are arranged to establish an electric field in the transmission line between the inner conductor and the outer conductor with a substantially $TE_{11}$ mode component along a direction perpendicular to the planar septum; and wherein a forward portion of the septum is asymmetrically disposed along the diameter, said septum having a pair of distal ends, a first distance between one of the pair of ends and a proximate portion of the outer conductor being different from a second distance between the other one of the pair of ends and a proximate portion of the outer conductor.

3. The feed structure recited in claim 2 wherein the center conductor is hollow.

4. The feed structure recited in claim 2 wherein the first distance increases along the transmission line from the rear portion of the septum to the forward portion of the septum.

5. The feed structure recited in claim 4 wherein the first distance is increased in steps to provide a phase shift to energy propagating along the transmission line between a distal end of the septum and the outer conductor.

6. The feed structure recited in claim 5 wherein the relative phase shift between a pair of orthogonal $TE_{11}$ modes is substantially plus or minus 90 degrees proximate the distal ends of the septum, depending upon whether left-hand or right-hand circularly polarized energy is produced.

* * * * *

UNITED STATES PATENT AND TRADEMARK OFFICE

CERTIFICATE OF CORRECTION

PATENT NO. : 6,724,277 B2
APPLICATION NO. : 09/771435
DATED : April 20, 2004
INVENTOR(S) : Holden et al.

It is certified that error appears in the above-identified patent and that said Letters Patent is hereby corrected as shown below:

Title Pg, Item (57) Abstract, line 19, delete “conductor has” and replace with --conductor and has--.

Col. 1, line 37, delete “reception the” and replace with --reception, the--.

Col. 1, line 65, delete “linearly polarized.” and replace with --linearly polarized energy.--.

Col. 2, line 13, delete “above the” and replace with --above, the--.

Col. 2, line 65, delete “embodiment the” and replace with --embodiment, the--.

Col. 3, line 64, delete “particularly the” and replace with --particularly, the--.

Col. 4, line 27, delete “septum is” and replace with --septum 34 is--.

Col. 4, line 29, delete “septum extends” and replace with --septum 34 extends--.

Col. 4, line 35, delete “transmission line which” and replace with --transmission line 30 which--.

Col. 4, line 49, delete “outer conductor by” and replace with --outer conductor 33 by--.

Col. 4, line 55, delete “septum 34 the” and replace with --septum 34 and the--.

Col. 4, line 58-59, delete “transmission line along” and replace with --transmission line 30 along--.

Col. 5, line 41, delete “septum” and replace with --septum 34--.

Col. 5, line 43, delete “90 degrees” and replace with --90 degree--.

Col. 6, line 10, delete “feed” and replace with --fed--.

Col. 6, line 16, delete “port” and replace with --ports--.

Col. 6, line 22, delete “feed 36’, 38’” and replace with --feed ports 36’, 38’--.

UNITED STATES PATENT AND TRADEMARK OFFICE

CERTIFICATE OF CORRECTION

PATENT NO. : 6,724,277 B2
APPLICATION NO. : 09/771435
DATED : April 20, 2004
INVENTOR(S) : Holden et al.

It is certified that error appears in the above-identified patent and that said Letters Patent is hereby corrected as shown below:

Col. 6, line 24, delete “septum” and replace with --septum 34--.

Col. 6, line 39, delete “FIGS. 11 and 12 the” and replace with --FIGS. 11 and 12, the--.

Col. 7, line 9, delete “FIGS” and replace with --FIGS.--.

Signed and Sealed this

Seventeenth Day of February, 2009

John Doll

JOHN DOLL
*Acting Director of the United States Patent and Trademark Office*